US008074319B2

(12) United States Patent
Huang

(10) Patent No.: US 8,074,319 B2
(45) Date of Patent: Dec. 13, 2011

(54) FOLDABLE TOOTHBRUSH

(76) Inventor: Hung-Yu Huang, Taipei Hsien (TW)

( * ) Notice: Subject to any disclaimer, the term of this patent is extended or adjusted under 35 U.S.C. 154(b) by 336 days.

(21) Appl. No.: 12/384,911

(22) Filed: Apr. 10, 2009

(65) Prior Publication Data

US 2010/0257682 A1 Oct. 14, 2010

(51) Int. Cl.
*A46B 7/02* (2006.01)
*A46B 5/00* (2006.01)
*A46B 15/00* (2006.01)

(52) U.S. Cl. ..... 15/185; 15/184; 15/144.1; 15/167.1; 132/308; 403/348

(58) Field of Classification Search ..... 15/184, 15/185, 172, 144.1, 144.3, 167.1; 132/308–313, 132/315, 150, 237, 238; 206/361, 362.2–362.3; 16/408, 111.1; 403/109.1, 109.2, 109.8, 403/109.7, 82, 83, 164, 165, 252, 348, 349, 403/353

See application file for complete search history.

(56) References Cited

U.S. PATENT DOCUMENTS 835,365 A * 11/1906 Morgan ..... 15/185
892,246 A * 6/1908 Gamber ..... 132/313
1,007,864 A * 11/1911 Goldy ..... 15/184
1,033,187 A * 7/1912 Metzger ..... 285/87
1,493,848 A * 5/1924 Ebert ..... 15/176.6
2,895,757 A * 7/1959 Kaspar ..... 403/100
2,937,910 A * 5/1960 Randa ..... 312/207
3,763,869 A * 10/1973 Sanders ..... 132/311
4,592,109 A * 6/1986 Borea et al. ..... 15/172
5,107,871 A * 4/1992 Butcher et al. ..... 132/304
5,407,293 A * 4/1995 Crainich ..... 403/322.1
5,735,298 A * 4/1998 Mayne et al. ..... 132/309
6,015,328 A * 1/2000 Glaser ..... 446/72
6,438,784 B1 * 8/2002 Yu ..... 15/106
2006/0289030 A1 * 12/2006 Pho ..... 132/309

* cited by examiner

*Primary Examiner* — Joseph J Hail
*Assistant Examiner* — Tyrone Hall, Jr.
(74) *Attorney, Agent, or Firm* — William E. Pelton; Cooper & Dunham LL

(57) ABSTRACT

A foldable toothbrush has a shell, a cover, a mounting sleeve, a handle and multiple bristles. The cover is mounted pivotally to the shell and selectively covers the top opening and part of the front opening of the shell. The mounting sleeve is mounted pivotally to the shell and is selectively pivoted into the shell. The handle is mounted in the mounting sleeve and is selectively rotatable and slidable in the mounting sleeve. The bristles are attached to the handle. With the handle being rotatable and slidable in the mounting sleeve, the whole length of the toothbrush is adjustable to selectively adapt for using or stowing. Furthermore, the cover keeps the handle and the bristles clean when stowing.

19 Claims, 21 Drawing Sheets

FOLDABLE TOOTHBRUSH

BACKGROUND OF THE INVENTION

1. Field of the Invention

The present invention relates to a toothbrush, especially to a foldable toothbrush.

2. Description of the Prior Arts

Toothbrushes are indispensable to modern people. To keep teeth clean and to be carried easily, conventional foldable toothbrushes are invented. With reference to FIGS. 26 and 27, a conventional foldable toothbrush comprises a handle (60), a neck shaft (70) and multiple bristles (80). The handle (60) is a hollow shell with a front opening and a top opening. The neck shaft (70) is mounted pivotally in the front opening of the handle (60) and has head. The bristles (80) are attached securely on the head. When using, the neck shaft (70) is pivoted out of the top opening of the handle (60). When stowing, the neck shaft (70) is pivoted into the top opening of the handle (60) and the bristles (80) face the bottom of the handle (60) to keep the bristles clean.

However, the conventional foldable toothbrush has following disadvantages:

1. To be carried easily, the handle (60) and the neck shaft (70) should be as short as possible. Nevertheless, the shorter the handle (60) and the neck shaft (70) are, the more inconvenient for the user to hold the toothbrush. On the contrary, the longer the handle (60) and the: neck shaft (70) are, the larger the volume of the conventional toothbrush to be and the more inconvenient for the user to carry the conventional toothbrush.

2. When the neck shaft (70) is pivoted into the top opening of the handle (60), the edges of the handle (60) are easily blocked and bend the bristles (80) to cause the bristles (80) damage.

3. When the conventional toothbrush is used, the head of the neck shaft (70) usually contacts with the user's month. However, the head of the neck shaft (70) is exposed when the conventional toothbrush is folded. Therefore, the head is easily polluted and virus and bacteria may attach on the head to cause the user sick.

To overcome the shortcomings, the present invention provides a foldable toothbrush to mitigate or obviate the aforementioned problems.

SUMMARY OF THE INVENTION

The main objective of the present invention is to provide a foldable toothbrush that has adjustable length and is kept clean when stowing. The foldable toothbrush has a shell, a cover, a mounting sleeve, a handle and multiple bristles. The cover is mounted pivotally to the shell and selectively covers the top opening of the shell. The mounting sleeve is mounted pivotally to the shell and is selectively pivoted into the shell. The handle is mounted in the mounting sleeve and is selectively rotatable and slidable in the mounting sleeve. The bristles are attached to the handle. With the handle being rotatable and slidable in the mounting sleeve, the whole length of the toothbrush is adjustable to selectively adapt for using or stowing. Furthermore, the cover keeps the handle and the bristles clean when stowing.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
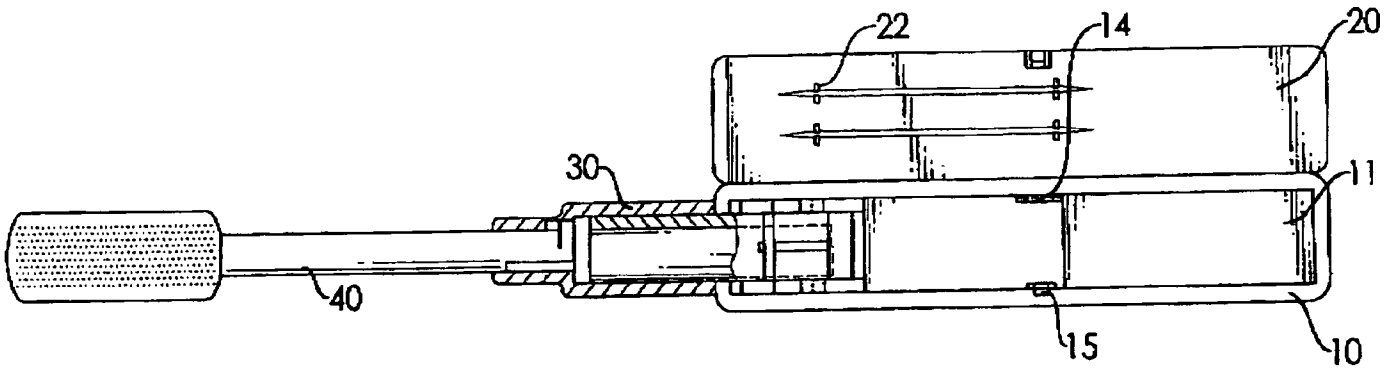
FIG. 1 is a top view in partial section of a first embodiment of a foldable toothbrush in accordance with the present invention.
Figure 2:
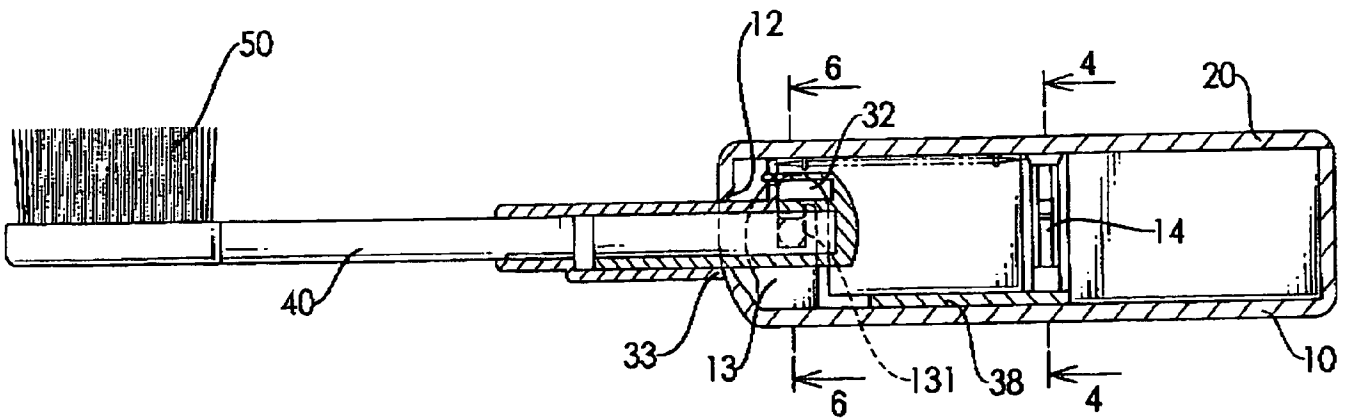
FIG. 2 is a side view in partial section of the foldable toothbrush in FIG. 1.

With reference to FIGS. 1 and 2, a foldable toothbrush in accordance with the present invention comprises a shell (10), a cover (20), a mounting sleeve (30), a handle (40) and multiple bristles (50).

Figure 3:
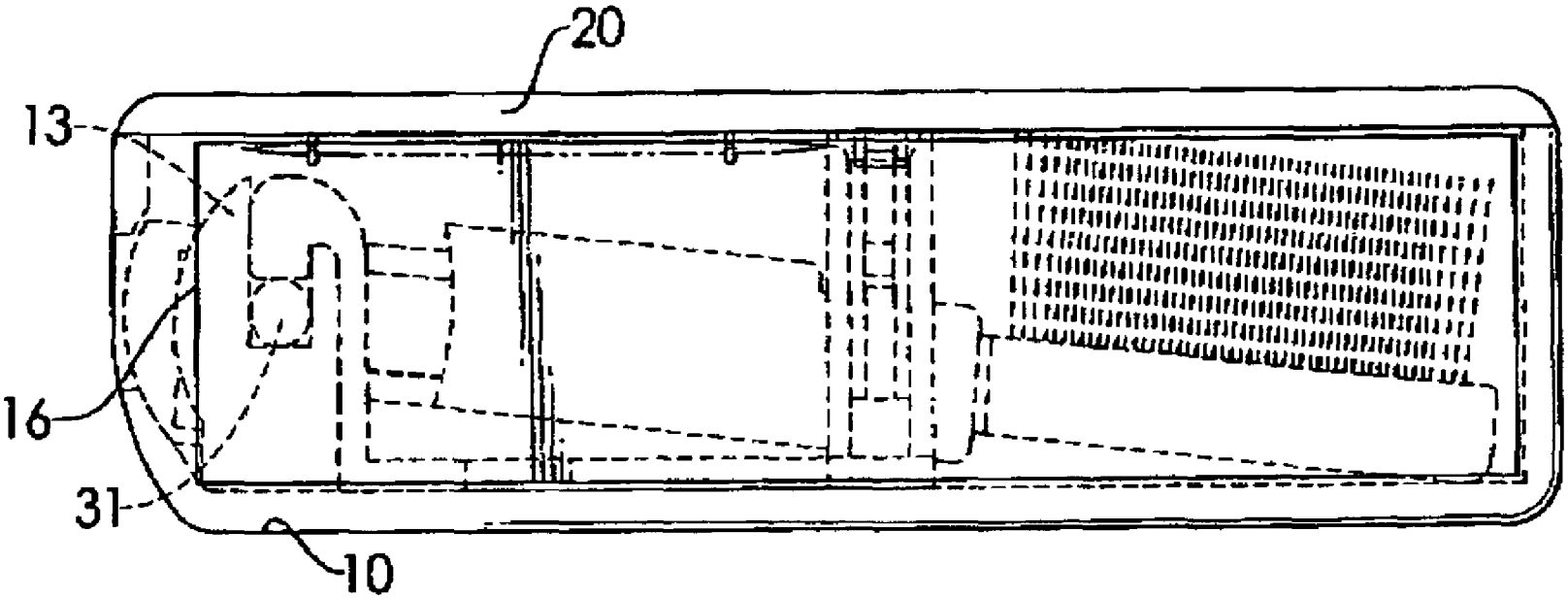
FIG. 3 is an operational enlarged side view of the foldable toothbrush in FIG. 1 showing folded.
Figure 4:
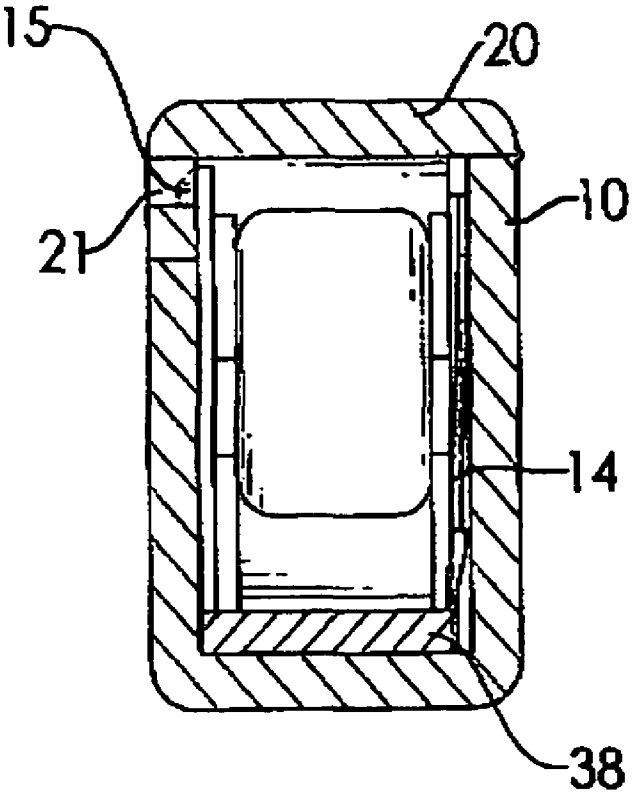
FIG. 4 is an end view in partial section of the foldable toothbrush along line 4-4 in FIG. 2.

With farther reference to FIGS. 3 and 4, the shell (10) is hollow and has a top opening (11), a front opening (12), a pivoting sidewall, a holding sidewall, two pivoting mounts (13), a resilient holder (14), a holding segment and a mirror (16). The pivoting sidewall has an inner surface and an outer surface. The holding sidewall has an inner surface and an outer surface. The pivoting mounts (13) are attached respectively to the inner surfaces of the pivoting and holding sidewalls. Each pivoting mount (13) has a pivoting recess (131) being formed in the edge of the pivoting mount (13). The resilient holder (14) is formed on the inner surface of the pivoting sidewall.

Figure 5:
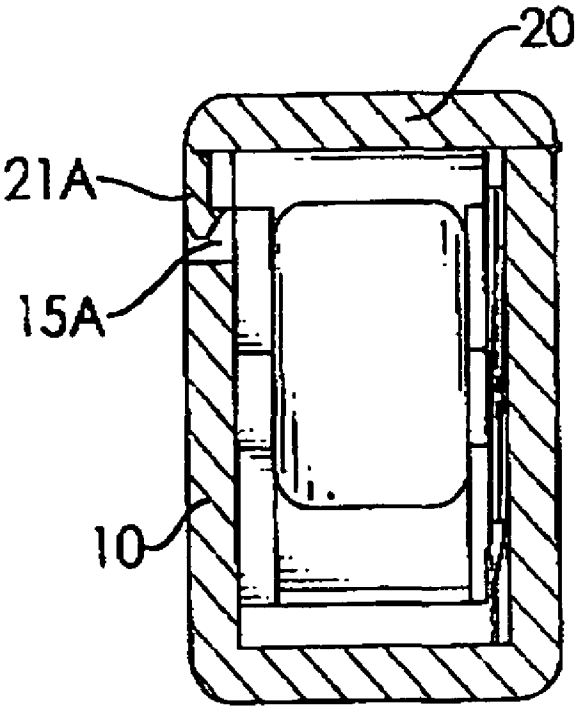
FIG. 5 is an end view in partial section of a second embodiment of a foldable toothbrush in accordance with the present invention.

With further reference to FIG. 5, the holding segment is formed on the holding sidewall near the top opening (11) and may be a locking protrusion (15) or a locking hole (15A). The locking protrusion (15) is formed on the outer surface of the holding sidewall. The locking hole (15A) is formed through the holding sidewall. The mirror (16) is attached securely to the outer surface of the holding sidewall.

The cover (20) is mounted pivotally to the pivoting sidewall of the shell (10), selectively covers the top opening (11) and part of the front opening (12) of the shell (10) and has a bottom surface, a distal side, multiple clips (22) and a holding segment. The clips (22) are formed on the bottom surface of the cover (20) to hold toothpicks. The holding segment of the cover (20) is formed on the distal side, selectively engage the holding segment of the shell (10) to hold the cover (20) covering on the shell (10) and may be a locking hole (21) or a hook (21A). The locking hole (21) is formed through the distal side of the cover (20) and engages the locking protrusion (15) of the shell (10). The hook (21A) is formed on the distal side of the cover (20) and engages the locking hole (15A) of the shell (10).

Figure 6:
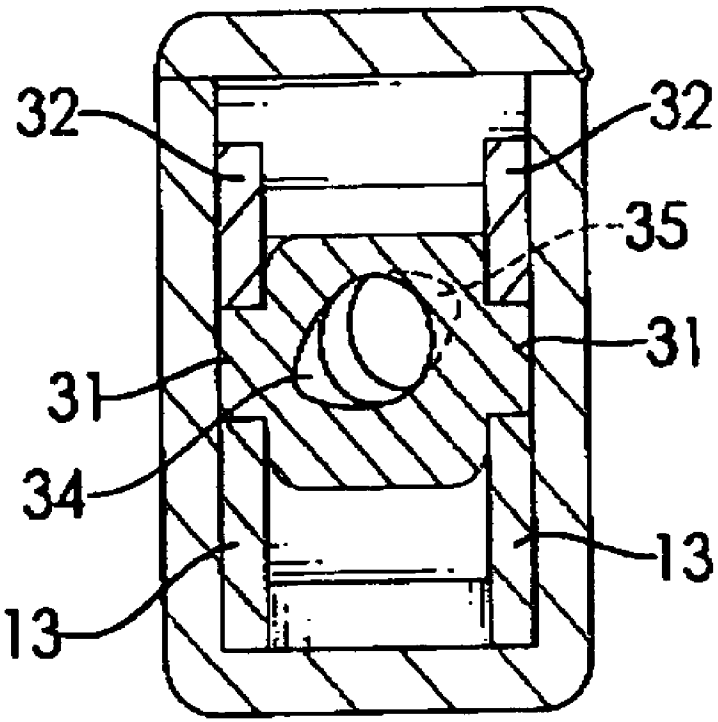
FIG. 6 is an end view in partial section of the foldable toothbrush along line 6-6 in FIG. 2.

With further reference to FIG. 6, the mounting sleeve (30) is hollow, is connected pivotally in the front opening (12) of the shell (10), may be selectively held by the resilient holder (14) and has a pivoting end, a distal end, an outer wall, two pivoting protrusions (31) and a longitudinal protrusion (33). The pivoting protrusions (31) are formed oppositely on and protrude transversely out of the outer wall of the mounting sleeve (30) and are respectively mounted pivotally in the pivoting recesses (131) of the pivoting mounts (13). The longitudinal protrusion (33) arm formed on the outer wall of the mounting sleeve (30) and selectively abuts the shell (10) near the front opening (12) when the mounting sleeve (30) is pivoted out of the shell (10).

Two arc clips (32) are attached respectively to the inner surfaces of the pivoting and holding sidewalls of the shell (10) and hold the pivoting protrusions (31) of the mounting sleeve (30) securely in the pivoting mounts (13). The arc clips (32), the resilient holder (14) and the locking protrusion (15) may be integrated formed on a connecting substrate (38).

The handle (40) is mounted rotatably and slidably in the distal end of the mounting sleeve (30), is selectively rotatable and slidable in the mounting sleeve (30) and has a head. The bristles (50) are attached to the head of the handle (40).

Figure 7:
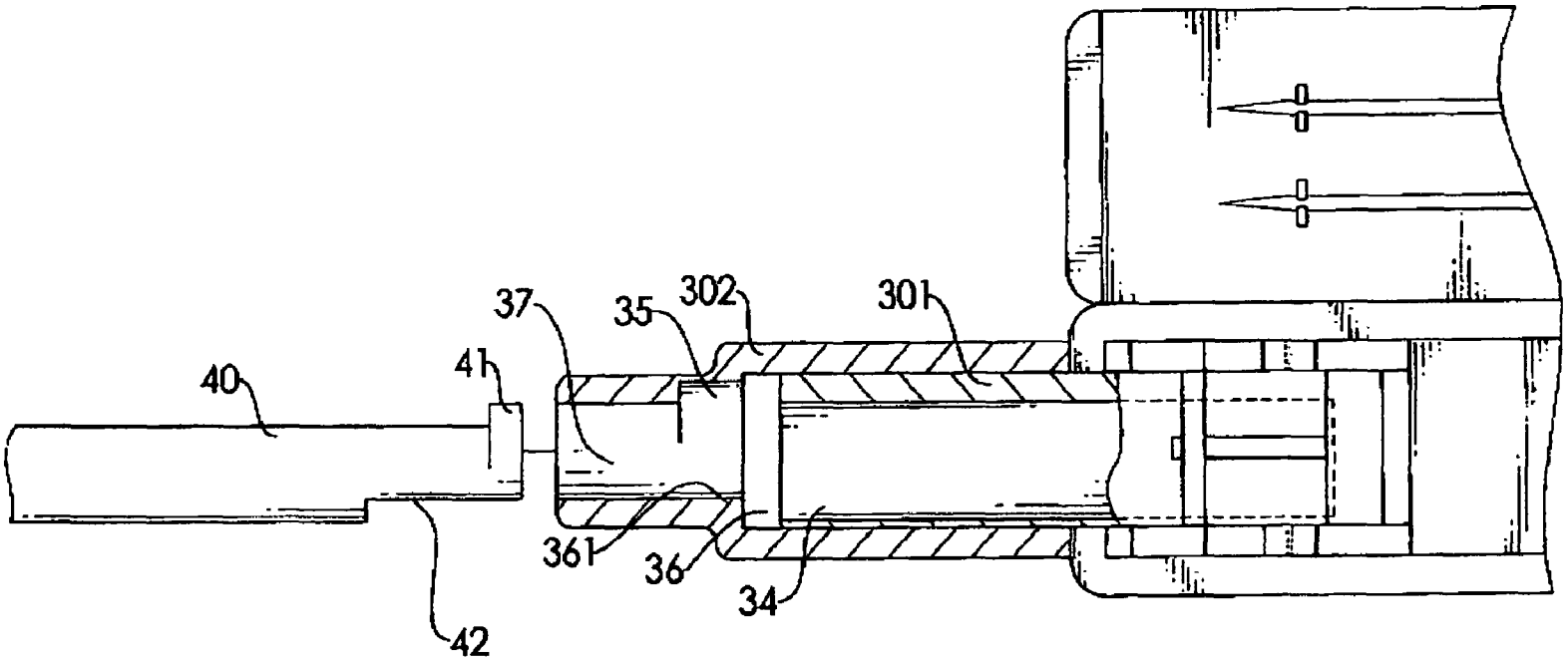
FIGS. 7 to 11 are enlarged operational views in partial section of the foldable toothbrush in FIG. 1 showing the handle being mounted into the mounting sleeve.
Figure 8:
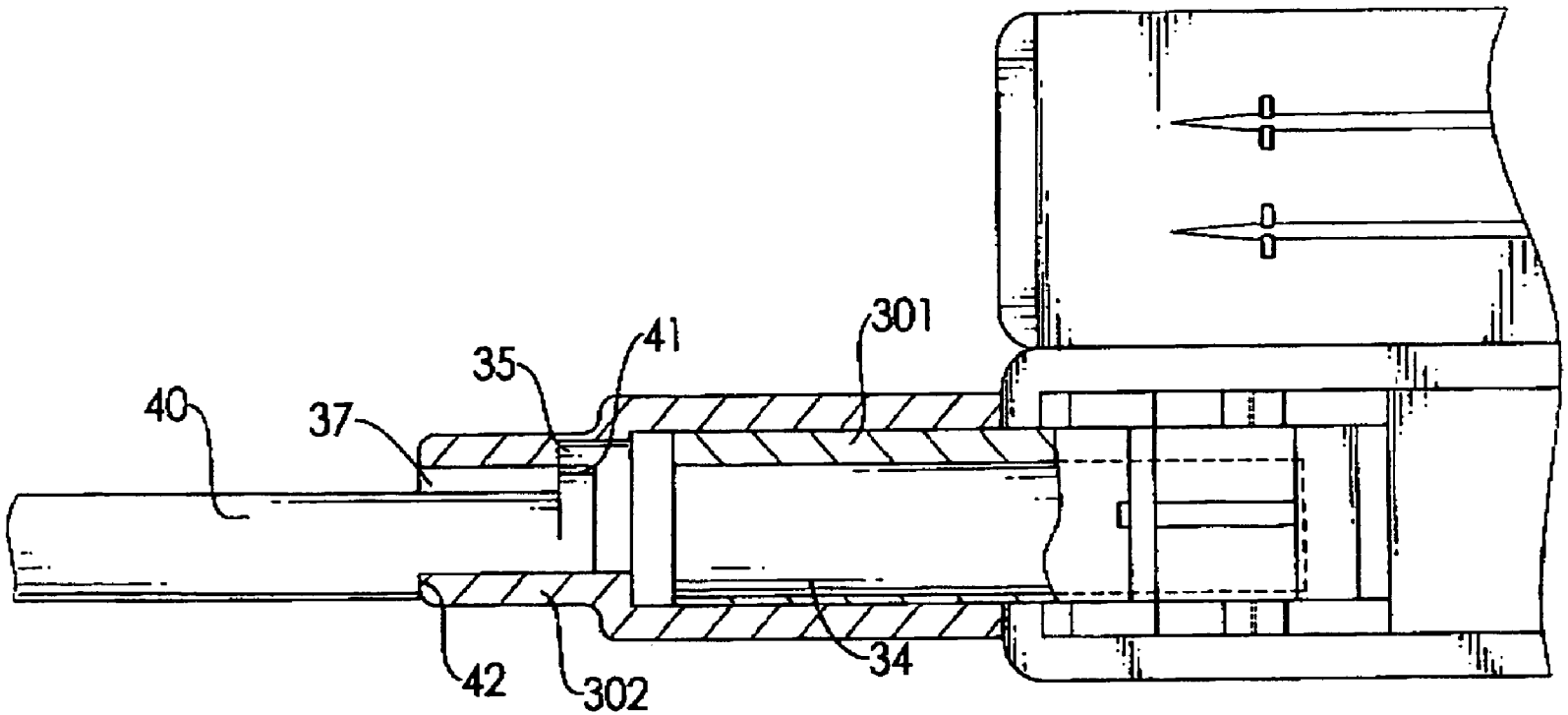
Figure 9:
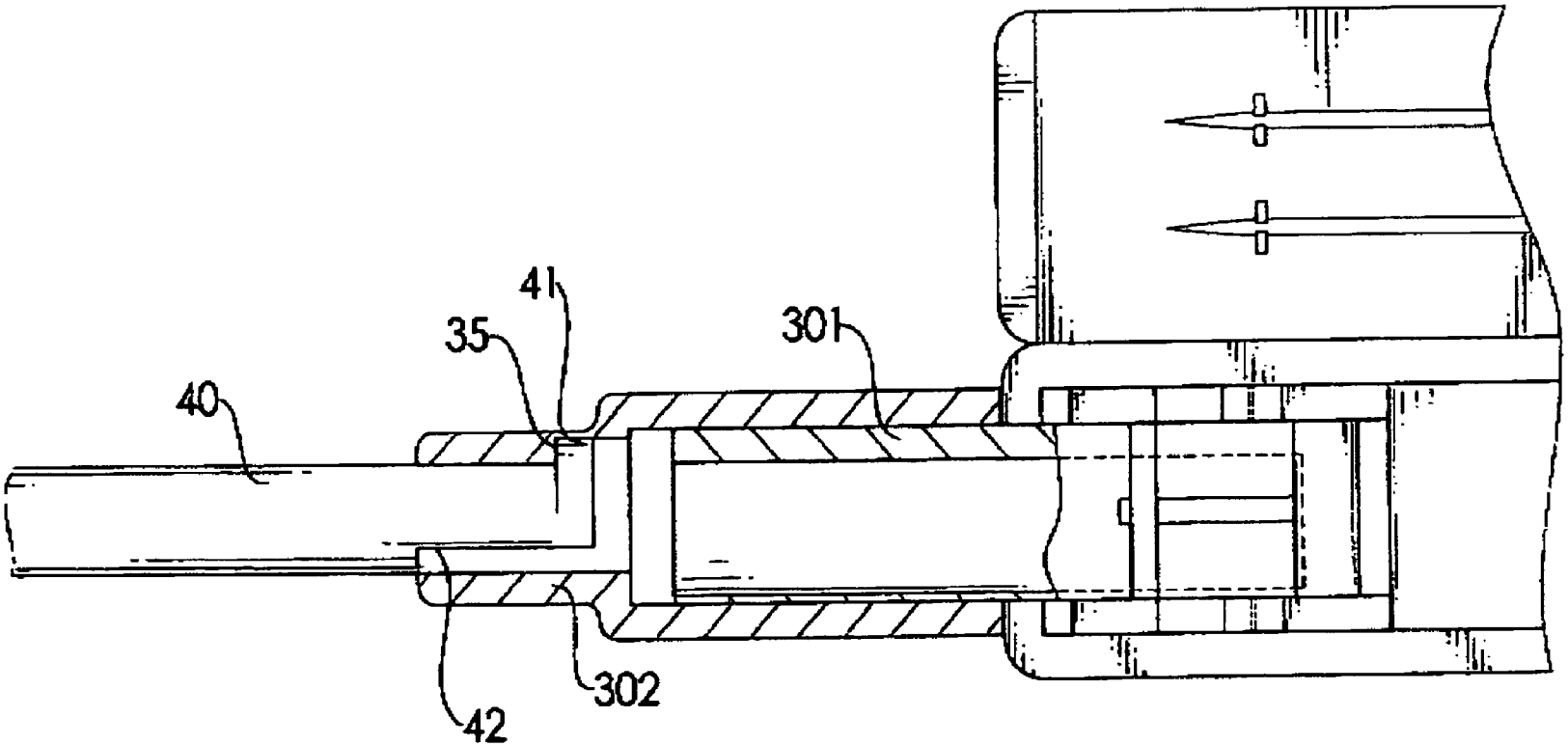
Figure 10:
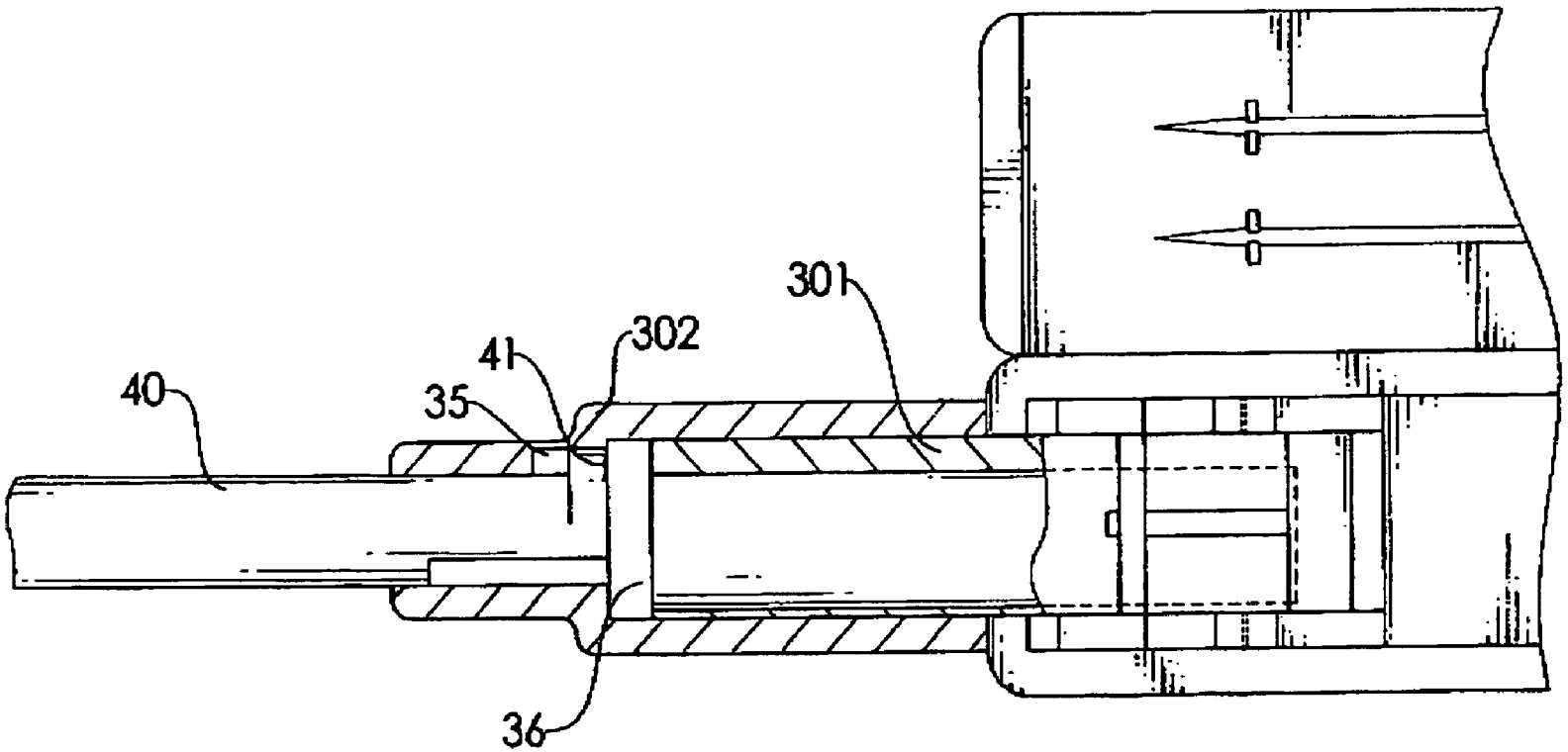
Figure 11:
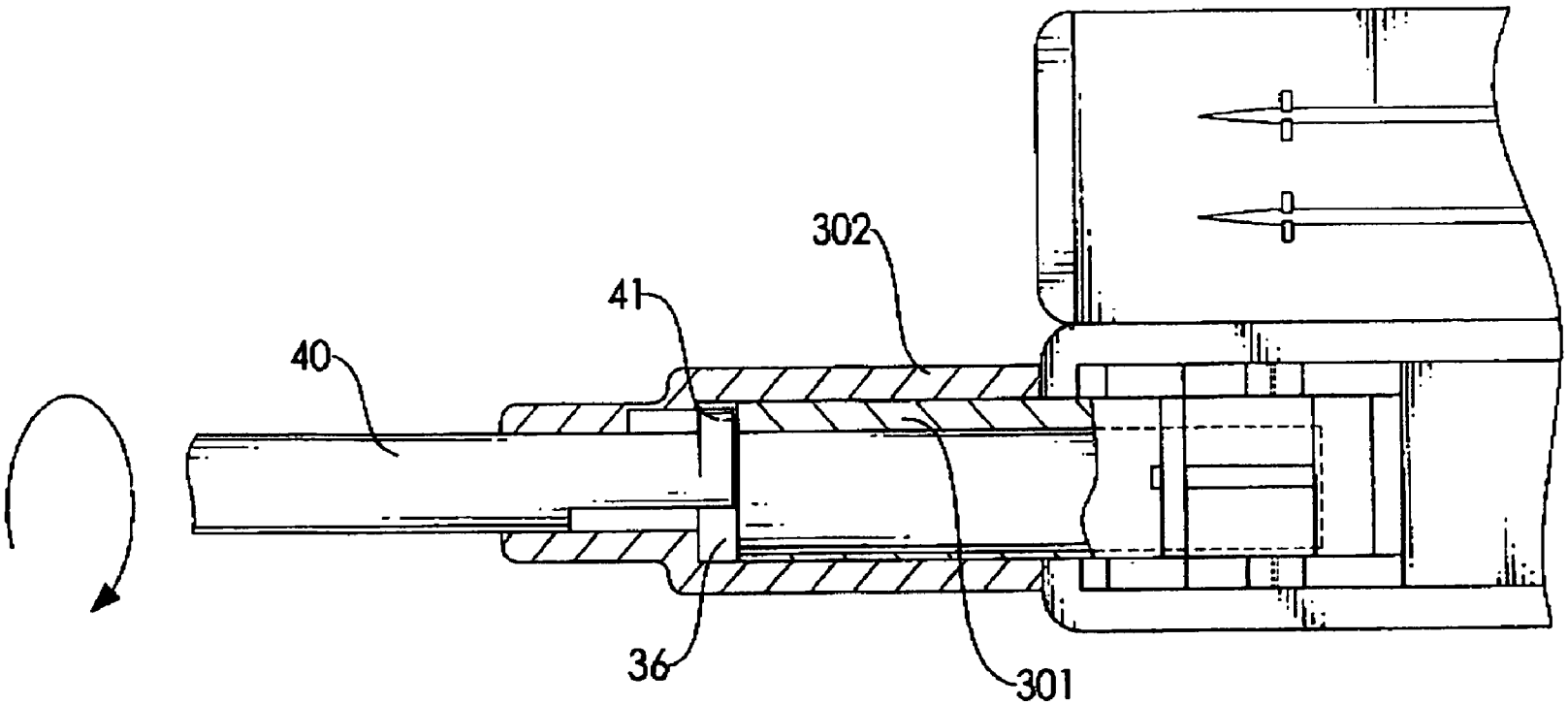
Figure 12:
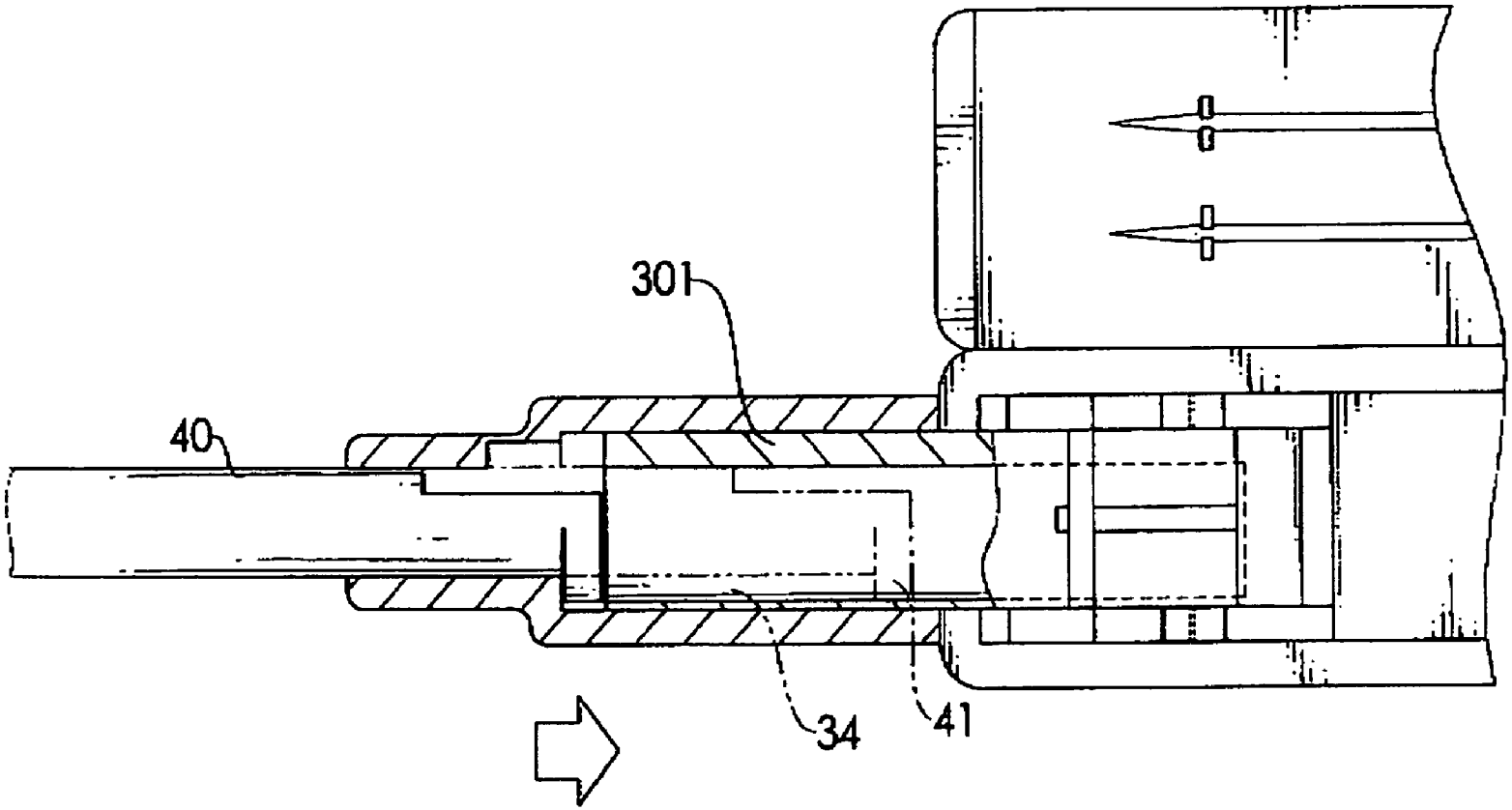
FIGS. 12 to 16 are enlarged operational views in partial section of the foldable toothbrush in FIG. 1 showing folding steps.
Figure 13:
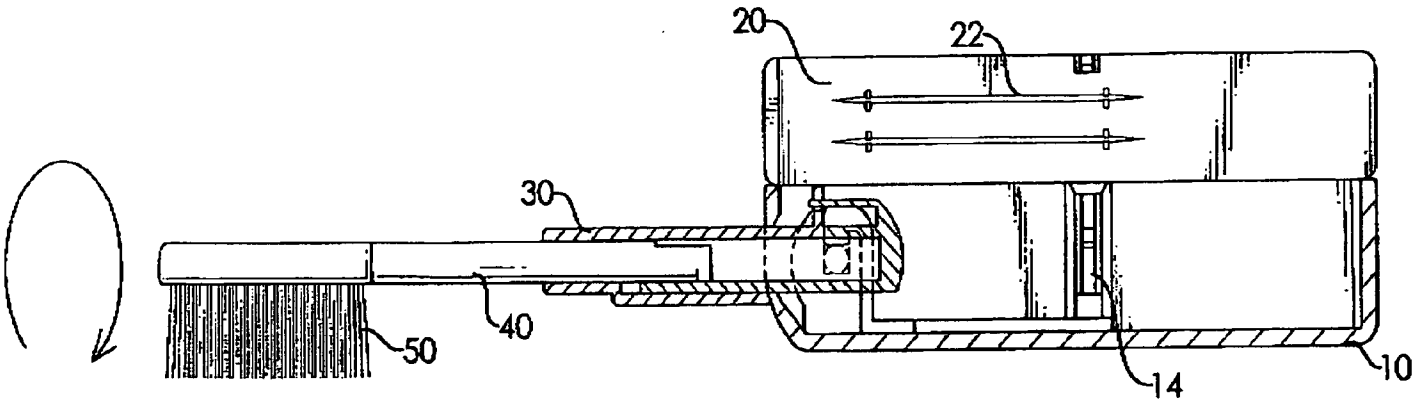
Figure 14:
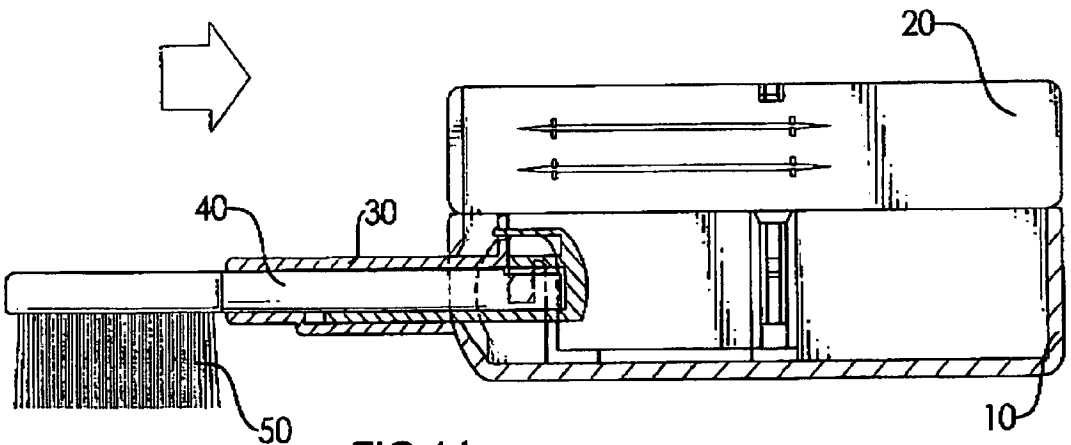
Figure 15:
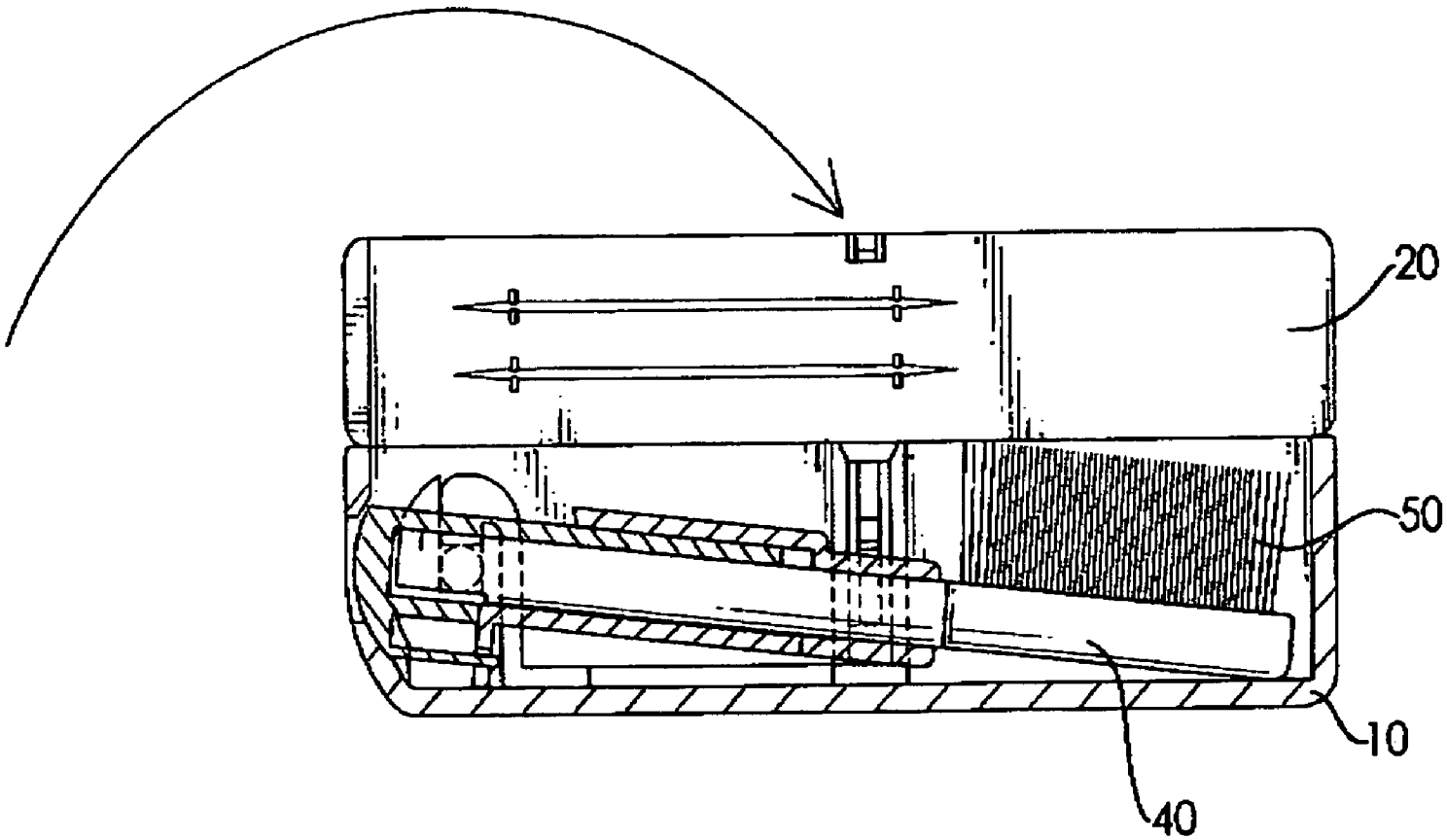
Figure 16:
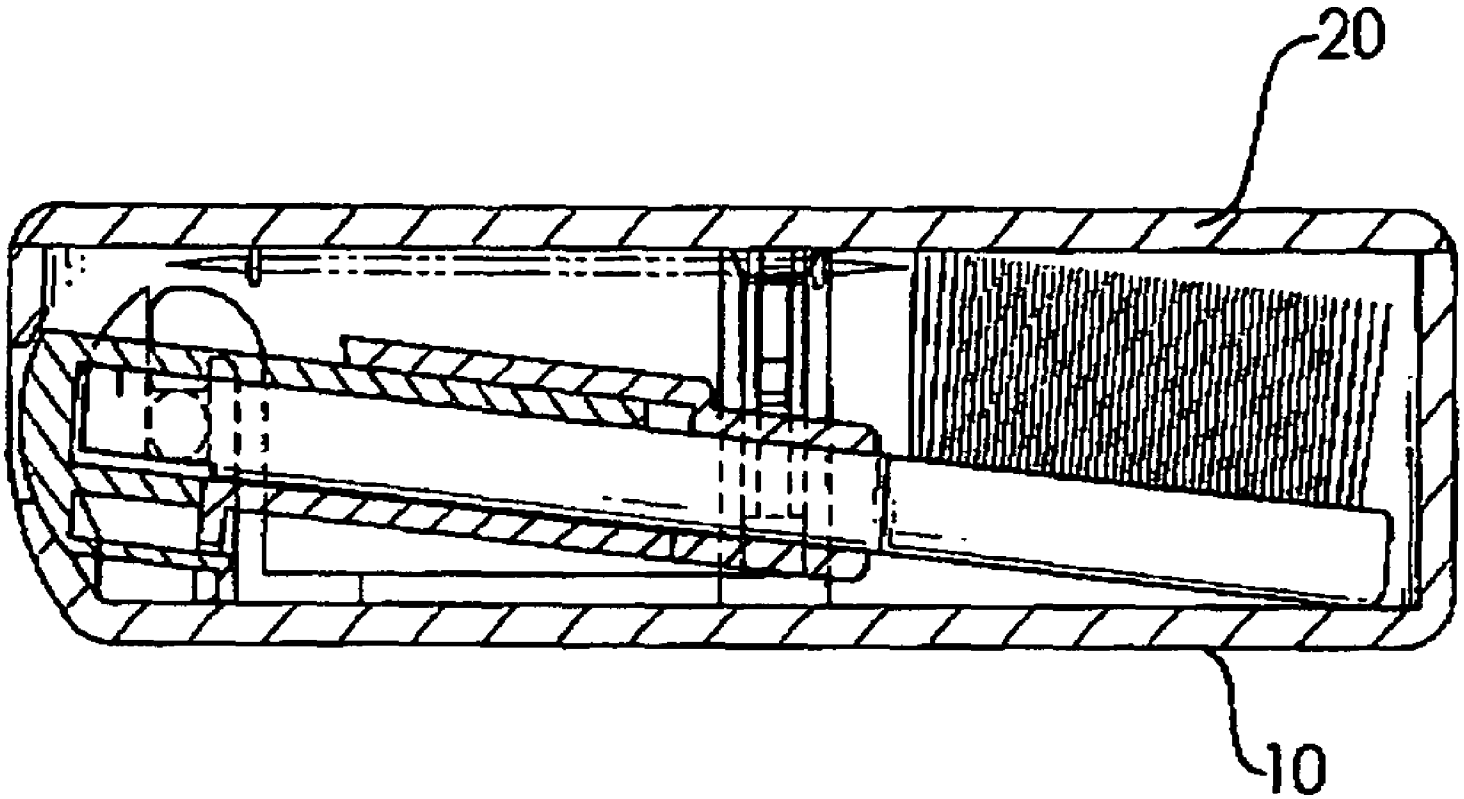
Figure 17:
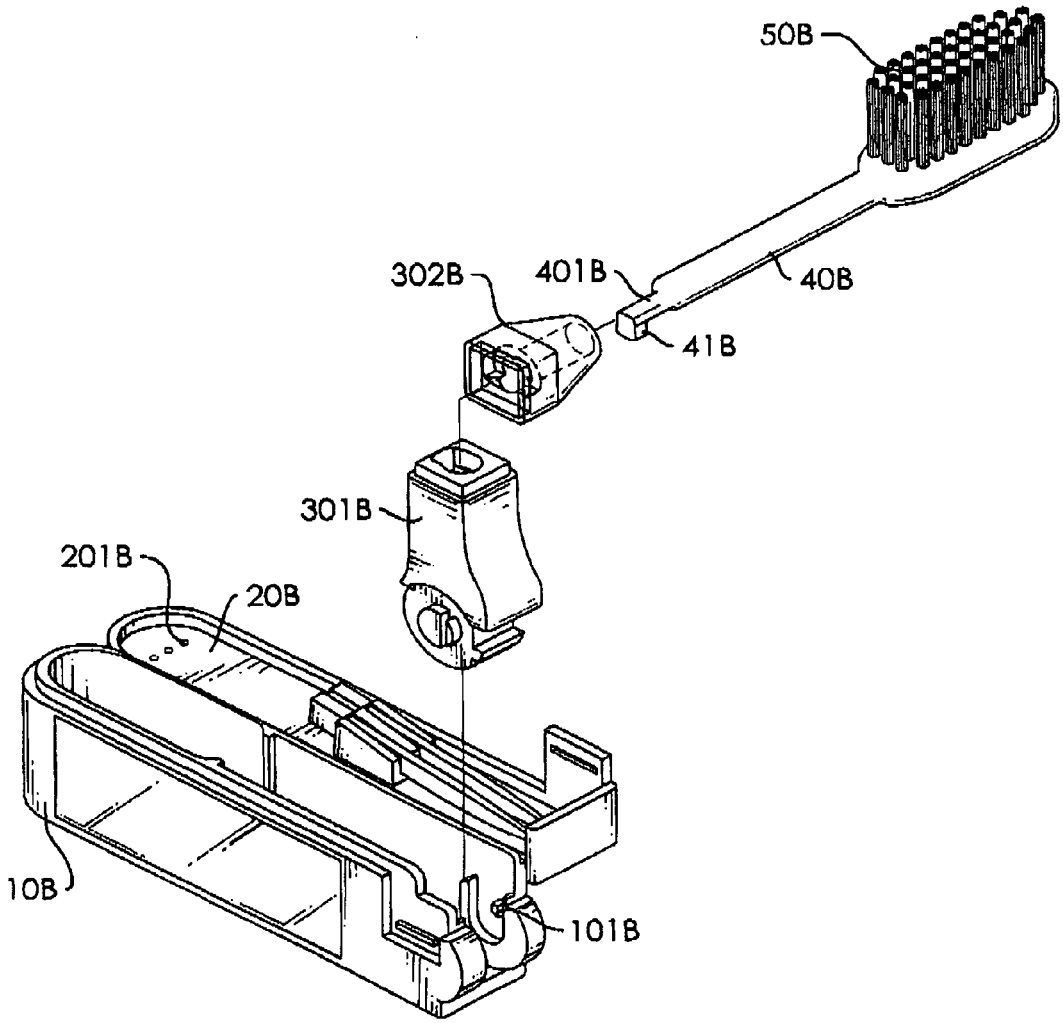
FIG. 17 is an exploded perspective view of a third embodiment of a foldable toothbrush in accordance with the present invention.
Figure 18:
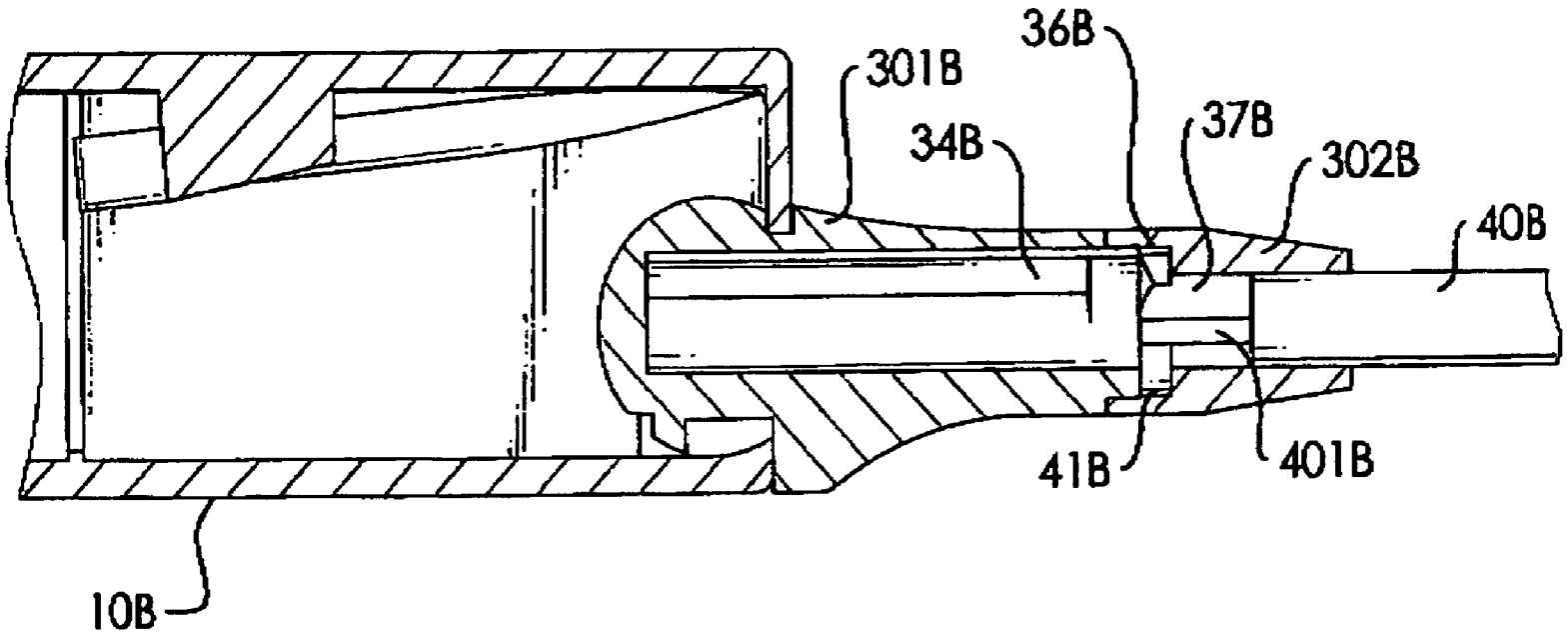
FIG. 18 is an enlarged side view in partial section of the foldable toothbrush in FIG. 17.
Figure 20:
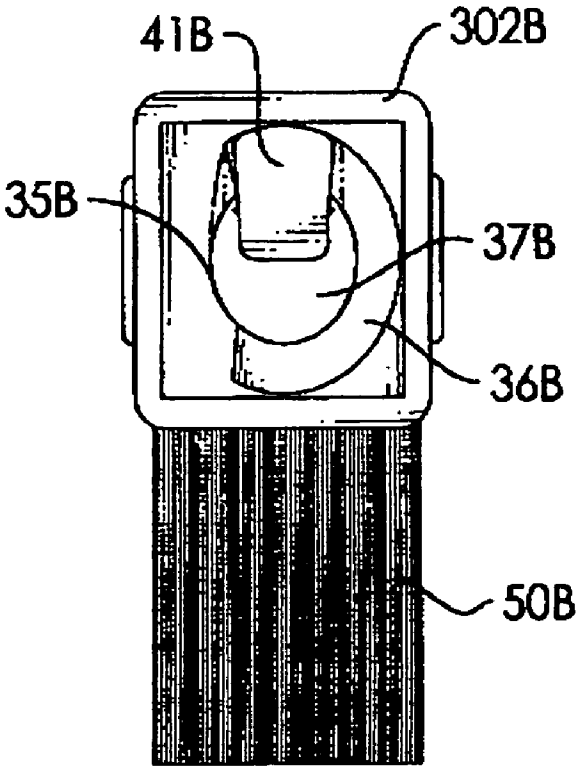
FIGS. 19 and 20 are enlarged rear views of the front sleeve and the handle of the foldable toothbrush in FIG. 17.
Figure 19:
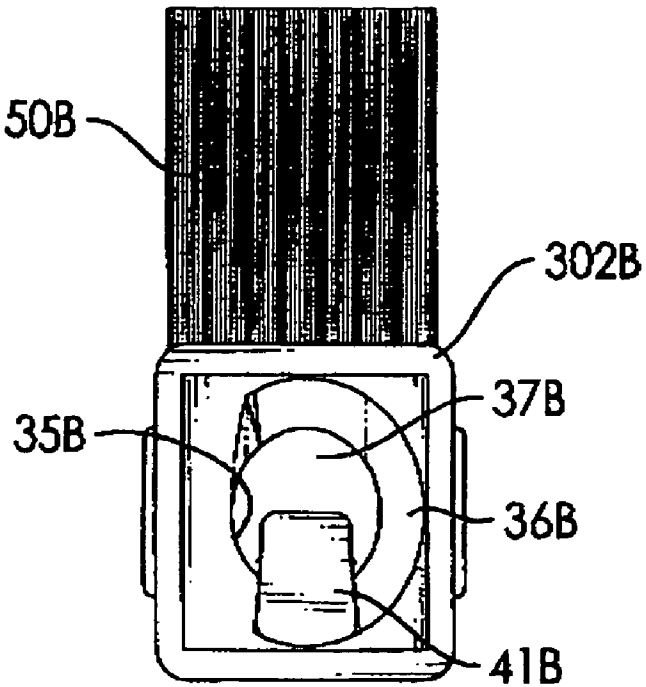
Figure 22:
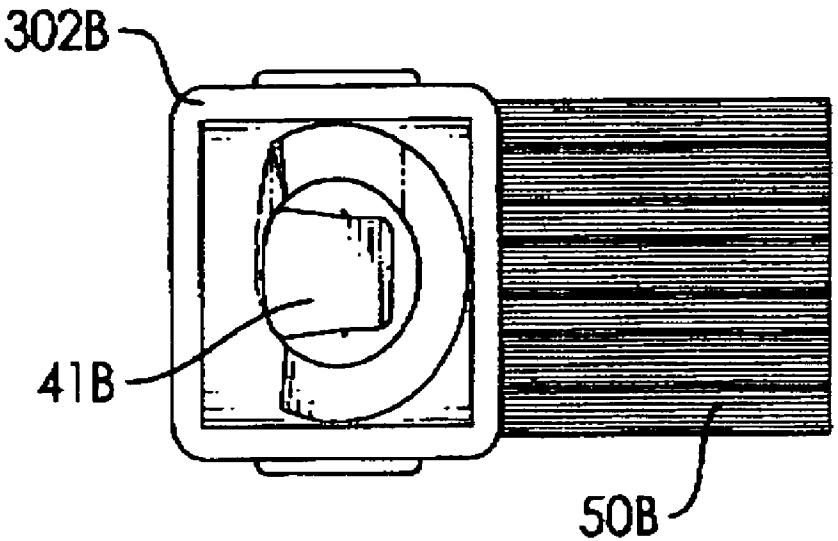
FIGS. 21 and 22 are enlarged operational front end views of the rear sleeve of the foldable toothbrush in FIG. 17.
Figure 21:
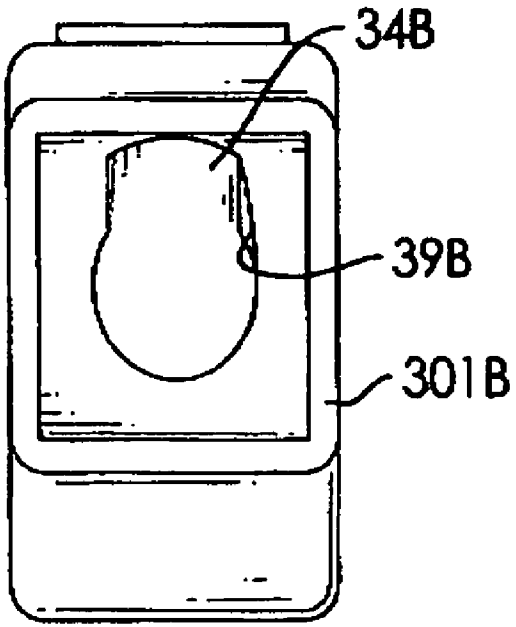

With reference to FIGS. 6 and 7, in a preferred embodiment, the mounting sleeve (30) may have an inner sleeve (301) and an outer sleeve (302) and the handle (40) may have a mounting end, an outer wall, an actuating protrusion (41) and an elongated recess (42). The inner sleeve (301) is mounted pivotally in the front opening (12) of the shell (10), is hollow and has an outer diameter, an inner diameter, a front end, an inner sidewall and an elongated limiting recess (34). The elongated limiting recess (34) is formed transversely in the inner sidewall of the inner sleeve (301). The outer sleeve (302) is mounted securely around the inner sleeve (301), is hollow and has a rear passage (36), a front passage (37), a limiting recess (35) and a shoulder (361). The rear passage (36) is adjacent to the front end of the inner sleeve (301), communicates with the elongated limiting recess (34) of the inner sleeve (301) and has an inner diameter being larger than the inner diameter of the inner sleeve (301). The front passage (37) communicates with the rear passage (36) and has an inner sidewall and an inner diameter being smaller than the inner diameter of the rear passage (36). The limiting recess (35) is formed transversely in the inner sidewall of the front passage (37) of the outer sleeve (302), is adjacent to the rear passage (36) and misaligns with the elongated limiting recess (34) of the inner sleeve (301). The shoulder (361) is formed between the rear and front passages (36, 37). The actuating protrusion (41) is formed on and protrudes transversely out from the mounting end of the handle (40), selectively protrudes into the limiting recess (35) and the elongated limiting recess (34) and selectively abuts the shoulder (361). The elongated recess (42) is formed transversely in the outer wall of the handle (40) to allow the actuating protrusion (41) being fitted into the front passage (37) of the outer sleeve (302).

With fixer reference to FIGS. 8 to 12, the handle (40) is inserted into the mounting sleeve (30). The actuating protrusion (41) is inserted into the front passage (37) of the outer sleeve (302). When the actuating protrusion (41) corresponds to the limiting recess (35) of the outer sleeve (302), the handle (40) is moved transversely to disengage the elongated recess (42) from the outer sleeve (302). The handle (40) is kept inserting into the mounting sleeve (30) and the actuating protrusion (41) protrudes in the rear passage (36) so that the handle (40) is free to rotate. When the handle (40) is rotated to misalign the actuating protrusion (41) with the elongated limiting recess, the handle (40) is non-retractable and is able to be used. When the handle (40) is rotated to align the actuating protrusion (41) with the elongated limiting recess (34), the handle (40) can be retracted into the inner sleeve (301).

With further reference to FIGS. 13 to 16, the toothbrush as described in folded. The handle (40) is rotated and is retracted into the mounting sleeve (30). The mounting sleeve (30) is pivoted into the shell (10) with the bristles (50) facing the top opening (11) of the shell (10). Then the cover (20) is pivoted to cover the top opening (11) of the shell (10) to keep the handle (40) and the bristles (50) clean.

With reference to FIGS. 17 to 22, in another preferred embodiment, the shell (10B) may have at least one stops (101B), the cover (20B) may have multiple orifices (201B) to ventilate, the mounting sleeve (30B) may have a rear sleeve (301B) and a front sleeve (302B) and the handle (40B) may have a mounting end, a protruding rod (401B) and an actuating protrusion (411B). The stop (101B) is formed in the shell (10B) adjacent to the front opening (12B) and abuts the mounting sleeve (301) to keep the mounting sleeve (30B) from departing from the shell (10B). The rear sleeve (301B) is mounted pivotally in the front opening (12B) of the shell (10B), is hollow and has an inner diameter, a front end, an inner sidewall, an elongated limiting recess (34B) and an inclined surface (39B). The elongated limiting recess (34B) is formed transversely in the inner sidewall of the rear sleeve (301B). The inclined surface (39B) is formed on the inner sidewall adjacent to the front end of the rear sleeve (301B) and is adjacent to the elongated limiting recess (34B). The front sleeve (302B) is mounted securely around the front end of the rear sleeve (301B), is hollow and has a rear passage (36B), a front passage (37B) and a limiting protrusion (35B). The rear passage (36B) is adjacent to the front end of the rear sleeve (301B), communicates with the elongated limiting recess (34B) of the rear sleeve (301B) and has an inner diameter being larger than the inner diameter of the rear sleeve (301B). The front passage (37B) communicates with the rear passage (36B) and has an inner sidewall and an inner diameter being smaller than the inner diameter of the rear passage (36B). The limiting protrusion (35B) is formed on and protrudes transversely out from the inner sidewall of the rear passage (36B) of the front sleeve (302B), is adjacent to the front end of the rear sleeve (301B), misaligns with the elongated limiting recess (34B) of the rear sleeve (301B) and corresponds to the inclined surface (39B) of the rear sleeve (301B). The protruding rod (401B) is formed longitudinally on the mounting end of the handle (40B) and has a distal end. The actuating protrusion (41B) is formed on and protrudes transversely out from the distal end of the protruding rod (401B), selectively protrudes into the elongated limiting recess (34B), selectively abuts the limiting protrusion (35B) and selectively slides along the inclined surface (39B). When the handle (40B) is rotated and the actuating protrusion (41B) slides along the inclined surface (39B), the actuating protrusion (41B) is pushed by the inclined surface (39B) to align with the front passage (37B) of the front sleeve (302B) so that the handle (40B) can be removed from the mounting sleeve (30B) through the front passage (37B). Therefore, the handle (40B) is replaceable easily to allow user to change clean bristles (50B) as desired.

Figure 23:
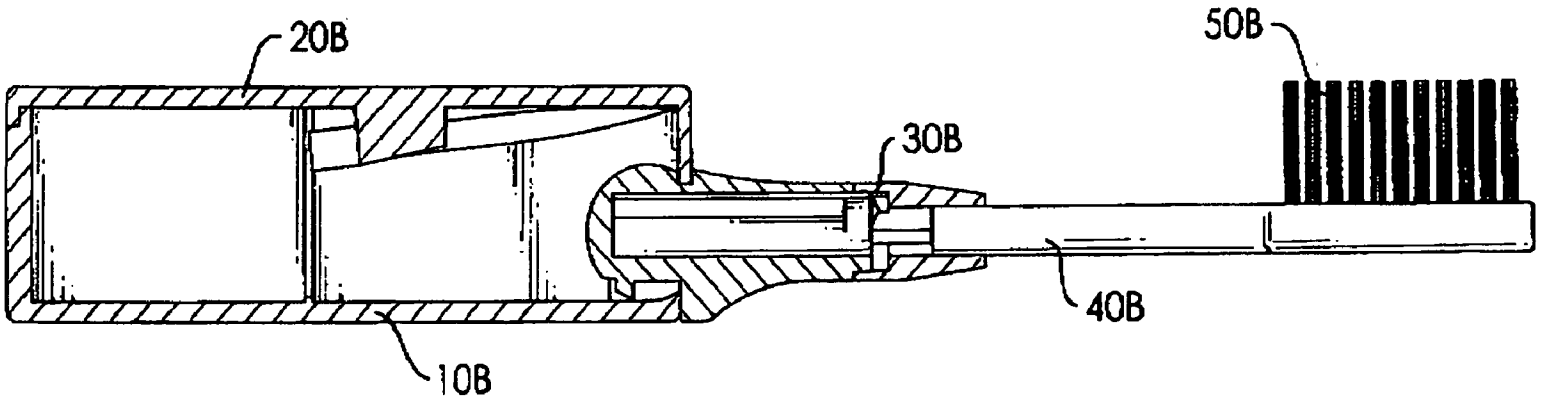
FIGS. 23 to 25 are operational-views in partial section of the foldable toothbrush in FIG. 17 showing folding steps.
Figure 24:
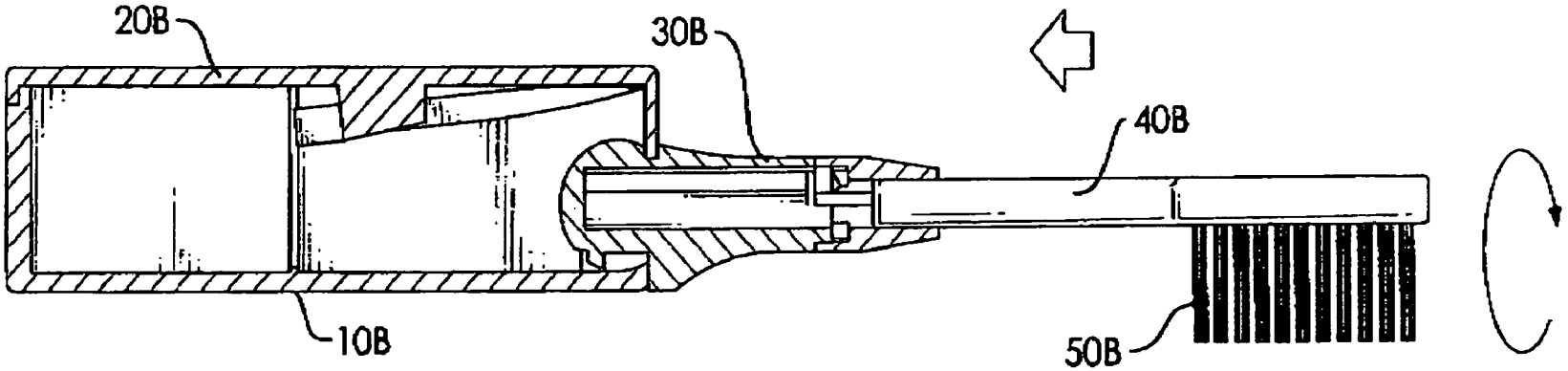
Figure 25:
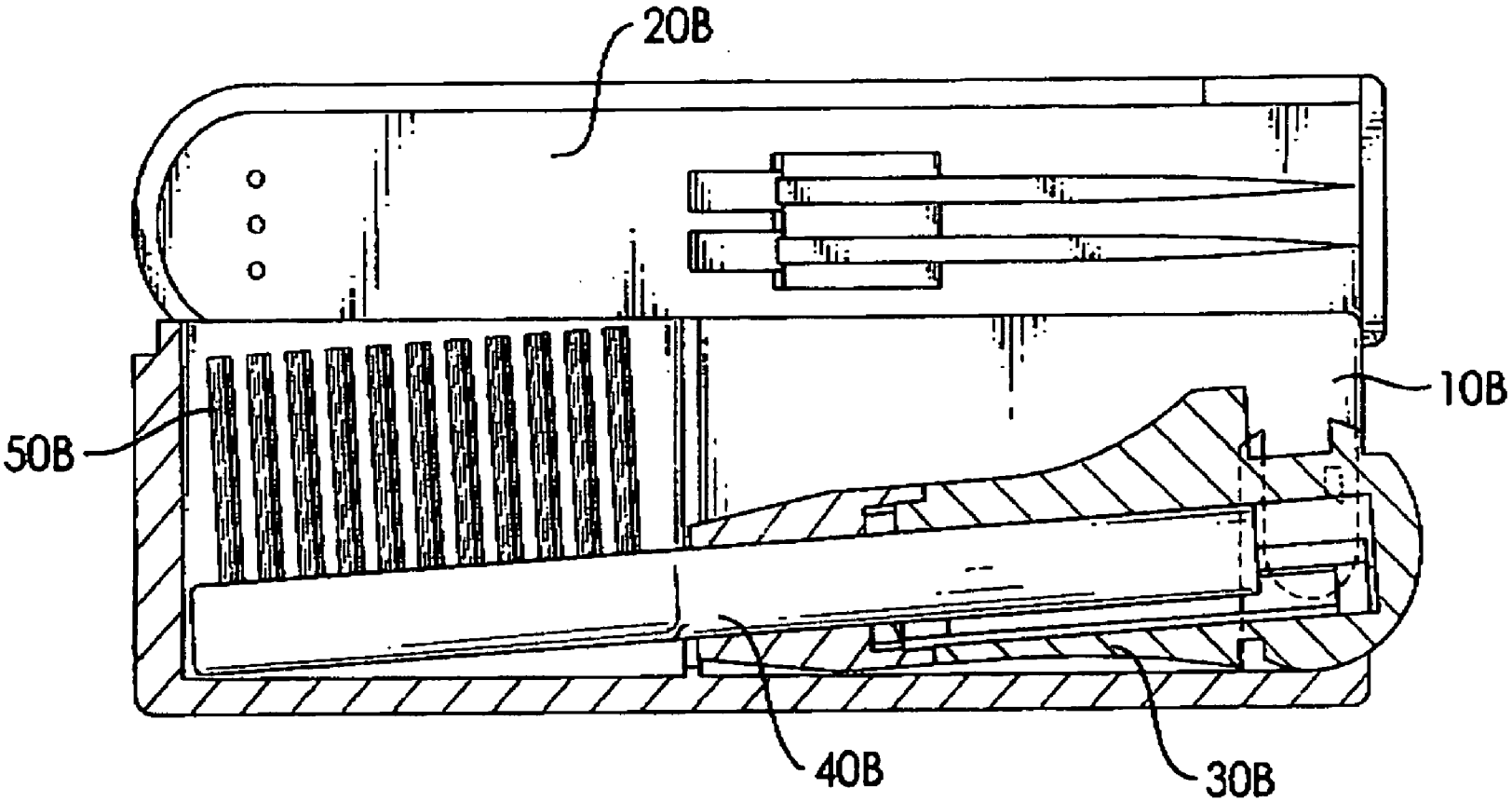
Figure 26:
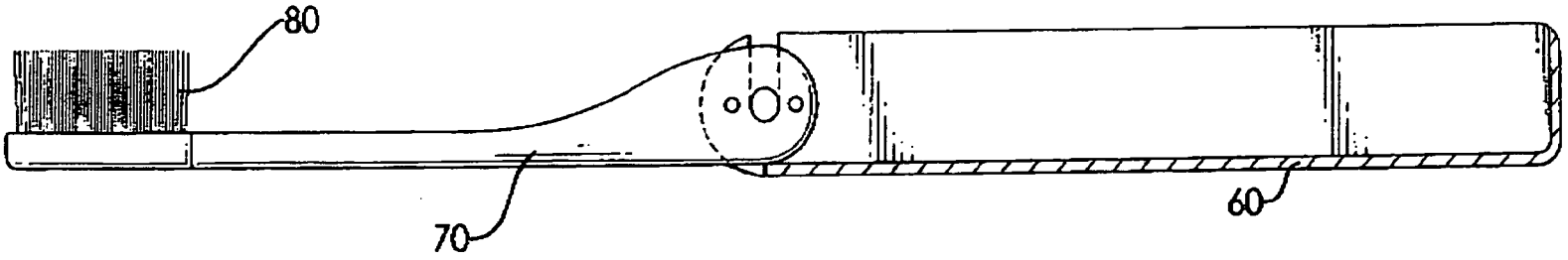
FIG.26 PRIOR ART
FIG. 26 is a side view in partial section of a conventional foldable toothbrush in accordance with the prior art.
Figure 27:
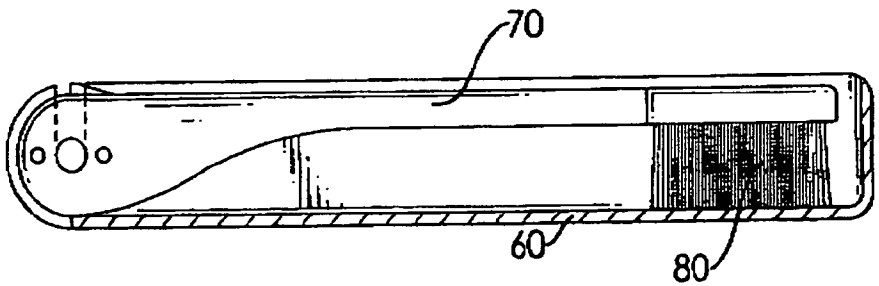
FIG.27 PRIOR ART
FIG. 27 is an operational side view in partial section of the conventional foldable toothbrush in FIG. 26 showing folded.

With further reference to FIGS. 23 to 25, the toothbrush as described in folded. The handle (40B) is rotated and is retracted into the mounting sleeve (30B). The mounting sleeve (30B) is pivoted into the shell (10B) with the bristles (50B) facing the top opening (11B) of the shell (10B). Then the cover (20B) is pivoted to cover the top opening (11B) of the shell (10B) to keep the handle (40B) and the bristles (50B) clean.

The toothbrush as described has advantages as follow:

1. With the mounting sleeve (30, 30B) and the handle (40, 40B), the user may adjust the whole length by sliding the handle (40, 40B). Therefore, the toothbrush as described can be long enough for using and can be short enough for stowing.

2. Since the handle (40, 40B) is free to rotate relative to the mounting sleeve (30, 30B), the handle (40, 40B) can be rotated to change the position of the bristles (50, 50B). Therefore, when the toothbrush as described is folded, the handle (40, 40B) is rotated to avoid the bristles (50, 50B) to abut the shell (10, 10B).

3. The cover (20, 20B) covers the top opening (11, 11B) of the shell (10) to keep the handle (40) and the bristles (50) clean.

4. Since the handle (40B) and the bristles (50B) are easily replaced, the user can only change dirty handle (40B) and dirty bristles (50B) without abandon the shell (10B), the cover (20) and the mounting sleeve (30B). Therefore, the present invention is more environmentally friendly.

Even though numerous characteristics and advantages of the present. invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the teres in which the appended claims are expressed.

What is claimed is:

1. A foldable toothbrush comprising:

a shell being hollow and having
- a top opening;
- a front opening;
- a pivoting sidewall having an inner surface and an outer surface;
- a holding sidewall having an inner surface and an outer surface; and
- a holding segment being formed on the holding sidewall near the top opening;

a cover being mounted pivotally to the pivoting sidewall of the shell, selectively covering the top opening of the shell and having
- a bottom surface;
- a distal side; and
- a holding segment being formed on the distal side and selectively engaging the holding segment of the shell;

a mounting sleeve being hollow, being connected pivotally in the front opening of the shell and having
- a pivoting end;
- a distal end; and
- an outer wall;

a handle being mounted in the distal end of the mounting sleeve, being selectively rotatable and slidable in the mounting sleeve and having a head; and multiple bristles being attached to the head of the handle;

wherein the mounting sleeve has an inner sleeve being mounted pivotally in the front opening of the shell, being hollow and having
- an outer diameter;
- an inner diameter;
- a front end;
- an inner sidewall; and
- an elongated limiting recess being formed transversely in the inner sidewall of the inner sleeve;

an outer sleeve being mounted securely around the inner sleeve, being hollow and having
- a rear passage being adjacent to the front end of the inner sleeve, communicating with the elongated limiting recess of the inner sleeve and having an inner diameter being larger than the inner diameter of the inner sleeve;
- a front passage communicating with the rear passage and having an inner sidewall and an inner diameter being smaller than the inner diameter of the rear passage;
- a limiting recess being formed transversely in the inner sidewall of the front passage of the outer sleeve, being adjacent to the rear passage and misaligning with the elongated limiting recess of the inner sleeve; and
- a shoulder being formed between the rear and front passages;

wherein the handle has
- a mounting end;
- an outer wall;
- an actuating protrusion being formed on and protruding transversely out from the mounting end of the handle, selectively protruding into the limiting recess and the elongated limiting recess and selectively abutting the shoulder; and
- an elongated recess being formed transversely in the outer wall of the handle.

2. The foldable toothbrush as claimed in claim 1, wherein the shell has two pivoting mounts being attached respectively to the inner surfaces of the pivoting and holding sidewalls, and each pivoting mount having a pivoting recess being formed in the edge of the pivoting mount; and the mounting sleeve has two pivoting protrusions being formed oppositely on and protruding transversely out of the outer wall of the mounting sleeve and being respectively mounted pivotally in the pivoting recesses of the pivoting mounts.

3. The foldable toothbrush as claimed in claim 2 further comprising two arc clips being attached respectively to the inner surfaces of the pivoting and holding sidewalls of the shell and holding the pivoting protrusions of the mounting sleeve securely in the pivoting mounts.

4. The foldable toothbrush as claimed in claim 3, wherein the shell has a resilient holder being formed on the inner surface of the pivoting sidewall; and the mounting sleeve is selectively held by the resilient holder.

5. The foldable toothbrush as claimed in claim 4, wherein the holding segment of the shell is a locking hole being formed through the holding sidewall; and the holding segment of the cover is a hook being formed on the distal side of the cover and engaging the locking hole of the shell.

6. The foldable toothbrush as claimed in claim 4, wherein
the holding segment of the shell is a locking protrusion being formed on the outer surface of the holding sidewall; and
the holding segment of the cover is a locking hole being formed through the distal side of the cover and engaging the locking protrusion of the shell.

7. The foldable toothbrush as claimed in claim 6, wherein the arc clips, the resilient holder and the locking protrusion are integrated formed on a connecting substrate.

8. The foldable toothbrush as claimed in claim 1, wherein
the shell has a resilient holder being formed on the inner surface of the pivoting sidewall; and
the mounting sleeve is selectively held by the resilient holder.

9. The foldable toothbrush as claimed in claim 1, wherein
the holding segment of the shell is a locking protrusion being formed on the outer surface of the holding sidewall; and
the holding segment of the cover is a locking hole being formed through the distal side of the cover and engaging the locking protrusion of the shell.

10. The foldable toothbrush as claimed in claim 1, wherein
the holding segment of the shell is a locking hole being formed through the holding sidewall; and
the holding segment of the cover is a hook being formed on the distal side of the cover and engaging the locking hole of the shell.

11. The foldable toothbrush as claimed in claim 1, wherein the shell has a mirror being attached securely to the outer surface of the holding sidewall.

12. The foldable toothbrush as claimed in claim 1, wherein the cover has multiple clips being formed on the bottom surface of the cover.

13. A foldable toothbrush comprising
a shell being hollow and having
a top opening;
a front opening;
a pivoting sidewall having an inner surface and an outer surface;
a holding sidewall having an inner surface and an outer surface; and
a holding segment being formed on the holding sidewall near the top opening;
a cover being mounted pivotally to the pivoting sidewall of the shell, selectively covering the top opening of the shell and having
a bottom surface;
a distal side; and
a holding segment being formed on the distal side and selectively engaging the holding segment of the shell;
a mounting sleeve being hollow, being connected pivotally in the front opening of the shell and having
a pivoting end;
a distal end; and
an outer wall;
a handle being mounted in the distal end of the mounting sleeve, being selectively rotatable and slidable in the mounting sleeve and having a head; and
multiple bristles being attached to the head of the handle;
wherein the mounting sleeve has
a rear sleeve being mounted pivotally in the front opening of the shell, being hollow and having
an inner diameter;
a front end;
an inner sidewall; and
an elongated limiting recess being formed transversely in the inner sidewall of the rear sleeve; and
a front sleeve being mounted securely around the front end of the rear sleeve, being hollow and having
a rear passage being adjacent to the front end of the rear sleeve, communicating with the elongated limiting recess of the rear sleeve and having an inner diameter being larger than the inner diameter of the rear sleeve;
a front passage communicating with the rear passage and having an inner sidewall and an inner diameter being smaller than the inner diameter of the rear passage; and
a limiting protrusion being formed on and protruding transversely out from the inner sidewall of the rear passage of the front sleeve, being adjacent to the front end of the rear sleeve and misaligning with the elongated limiting recess of the rear sleeve; and
wherein the handle has
a mounting end;
a protruding rod being formed longitudinally on the mounting end of the handle and having a distal end; and
an actuating protrusion being formed on and protruding transversely out from the distal end of the protruding rod, selectively protruding into the elongated limiting recess and selectively abutting the limiting protrusion.

14. The foldable toothbrush as claimed in claim 13, wherein
the rear sleeve of the mounting sleeve has
an inclined surface being formed on the inner sidewall adjacent to the front end of the rear sleeve and being adjacent to the elongated limiting recess and corresponding to the limiting protrusion of the limiting protrusion of the front sleeve; and
the actuating protrusion of the handle selectively slides along the inclined surface of the rear sleeve.

15. The foldable toothbrush as claimed in claim 14, wherein
the shell has a resilient holder being formed on the inner surface of the pivoting sidewall; and
the mounting sleeve is selectively held by the resilient holder.

16. The foldable toothbrush as claimed in claim 15, wherein
the holding segment of the shell is a locking hole being formed through the holding sidewall; and
the holding segment of the cover is a hook being formed on the distal side of the cover and engaging the locking hole of the shell.

17. The foldable toothbrush as claimed in claim 16, wherein the shell has at least one stop being formed in the shell adjacent to the front opening and abutting the mounting sleeve.

18. The foldable toothbrush as claimed in claim 17, wherein the cover has multiple orifices.

19. The foldable toothbrush as claimed in claim 15, wherein
the holding segment of the shell is a locking protrusion being formed on the outer surface of the holding sidewall; and
the holding segment of the cover is a locking hole being formed through the distal side of the cover and engaging the locking protrusion of the shell.

* * * * *